US010478697B2

(12) United States Patent
Arevalo

(10) Patent No.: US 10,478,697 B2
(45) Date of Patent: Nov. 19, 2019

(54) SOCCER TRAINING APPARATUS

(71) Applicant: Alvaro Luis Arevalo, Vacaville, CA (US)

(72) Inventor: Alvaro Luis Arevalo, Vacaville, CA (US)

( * ) Notice: Subject to any disclaimer, the term of this patent is extended or adjusted under 35 U.S.C. 154(b) by 0 days.

(21) Appl. No.: 15/848,115

(22) Filed: Dec. 20, 2017

(65) Prior Publication Data

US 2018/0169495 A1 Jun. 21, 2018

Related U.S. Application Data

(60) Provisional application No. 62/436,745, filed on Dec. 20, 2016.

(51) Int. Cl.
*A63B 69/00* (2006.01)

(52) U.S. Cl.
CPC ..... *A63B 69/002* (2013.01); *A63B 69/0059* (2013.01); *A63B 2209/10* (2013.01); *A63B 2225/09* (2013.01); *A63B 2243/0025* (2013.01)

(58) Field of Classification Search
CPC ..... A63B 69/002; A63B 69/0059; A63B 69/3608; A63B 69/36; A63B 69/00; A63B 60/40
USPC ..... 473/450, 458, 464, 438, 446, 215, 422, 473/518; 482/92, 128; 2/463; D21/791, D21/685, 788, 698
See application file for complete search history.

(56) References Cited

U.S. PATENT DOCUMENTS 1,591,524 A * 7/1926 Fuller ..... A63B 69/3608 473/215
2,228,586 A * 1/1941 Protzky ..... A63B 60/40 473/518
4,688,800 A * 8/1987 Lopez ..... A63B 69/3608 473/215
4,883,276 A * 11/1989 Brown ..... A63B 69/0059 473/215
4,960,280 A 10/1990 Corder
5,135,446 A * 8/1992 Cooley ..... A63B 69/0022 482/88
5,154,416 A 10/1992 Smull et al.
5,188,365 A 2/1993 Picard
5,390,929 A * 2/1995 Todaro ..... A63B 69/0059 473/215
5,643,097 A * 7/1997 Bechler ..... A63B 69/3608 473/215
5,658,203 A * 8/1997 Shub ..... A63B 69/0059 473/205

(Continued)

*Primary Examiner* — Mitra Aryanpour
(74) *Attorney, Agent, or Firm* — PatentFile, LLC; Bradley C. Fach; Steven R. Kick

(57) ABSTRACT

A soccer training apparatus configured to require a user to lean forward to observe portions of the ball while moving and standing with the ball is provided. The apparatus may include a harness configured to attach to the torso of a user and a sight shield coupled to the harness. The sight shield may be positioned on the chest of the user when the harness is attached to the torso of the user, and the sight shield may be configured to obscure the area immediately in front of the user. The apparatus may also comprise a backing plate which may be coupled to the sight shield, and the backing plate may also be coupled to the harness. Optionally, the sight shield may be movably coupled to the backing plate to allow the sight shield to be repositioned on the user.

9 Claims, 12 Drawing Sheets

(56) References Cited

U.S. PATENT DOCUMENTS

| | | | | |
|---|---|---|---|---|
| 5,785,603 | A | 7/1998 | Lazier | |
| 5,879,240 | A * | 3/1999 | Stuart | A63B 69/3608 473/215 |
| 5,950,760 | A | 9/1999 | Morrison | |
| 6,932,724 | B2 * | 8/2005 | Socci | A63B 69/0002 473/422 |
| 6,994,633 | B2 | 2/2006 | Czaja et al. | |
| 7,217,201 | B2 * | 5/2007 | Sealy | A63B 69/0059 473/422 |
| 7,686,699 | B2 | 3/2010 | Snyders | |
| 8,152,659 | B1 * | 4/2012 | Wadley | A63B 47/001 473/438 |
| D753,778 | S * | 4/2016 | Toomey | D21/698 |
| 9,682,303 | B2 | 6/2017 | Vilhelmsen | |
| 2002/0121742 | A1 * | 9/2002 | Stauber | A63B 69/0024 473/422 |
| 2005/0153817 | A1 * | 7/2005 | Fogarty | A63B 69/0059 482/51 |
| 2012/0291187 | A1 * | 11/2012 | Hawthorne, Jr. | A63B 71/12 2/463 |
| 2014/0274435 | A1 * | 9/2014 | Licata | A63B 69/3608 473/215 |
| 2016/0236052 | A1 * | 8/2016 | Sunday | A63B 69/00 473/458 |
| 2018/0169495 | A1 * | 6/2018 | Arevalo | A63B 69/0059 473/458 |

* cited by examiner

SOCCER TRAINING APPARATUS

CROSS REFERENCE TO RELATED APPLICATIONS

This application claims priority to and the benefit of the filing date of U.S. Provisional Application No. 62/436,745, filed on Dec. 20, 2016, entitled "SOCCER TRAINING APPARATUS", which is hereby incorporated by reference in its entirety.

FIELD OF THE INVENTION

This patent specification relates to the field of apparatuses configured to improve athletic performance. More specifically, this patent specification relates to apparatuses that train correct posture for improving athletic performance in ball contacting sports.

BACKGROUND

The most common mistake or deficiency in developing sports players of athletic activities is the development of improper or poor body posture. Poor posture is the posture that results from certain muscles tightening up or shortening while others lengthen and become weak which often occurs as a result of one's daily activities and athletic activates. There are different factors which can impact on posture and they include occupational activities and biomechanical factors such as force and repetition. Unfortunately, after a time, poor posture feels normal and continues to regress further from correct posture.

There are numerous drawbacks associated with poor posture in physical activities. Poor posture can impede the ability of the lungs to expand and decrease respiratory performance. Poor posture is also a main risk factor and contributor to many injuries. Many athletic injuries are the result of poor posture. Incorrect posture when participating in sports can also impede an individual from performing sports activities at their greatest capacity.

In ball contacting sports such as soccer, it is important to maintain good posture not only to prevent injuries, but also to increase movement and control when in possession of the ball. Good posture in ball contacting sports is perhaps best demonstrated by the maintaining the upper torso as slightly forward leaning position over the ball. This position is optimal for shooting, passing, dribbling, and other ball control maneuver and especially so in small areas.

Learning and maintaining a posture of a slightly forward leaning position over the ball often proves quite difficult for many players. The tendency to lean back away from the ball, a characteristic of poor posture, often comes naturally to a significant number of individuals. Unfortunately, current training practices to encourage and maintain good posture in ball contacting sports are limited to coaches and other observers watching the players and audibly providing them with posture feedback. This is time consuming as observers are only able to observe a limited number of players at a time, thereby decreasing the amount of training practice a player can receive. Other practices include recording videos of the players, but this also requires a significant investment of time decreasing the amount of training practices a player can receive. Without sufficient training practices poor posture can develop.

Therefore, a need exists for novel apparatuses for improving sports performance. There also exists a need for novel apparatuses for training players of ball contacting sports to possess and maintain good posture. There is a further need for novel apparatuses for good posture training that allow a player to train without individual observation. Finally, there exists a need for novel apparatuses for good posture training that do not require a significant investment of time decreasing the amount of training practice a player can receive.

BRIEF SUMMARY OF THE INVENTION

A soccer training apparatus is provided which is configured to require a user to lean forward to observe portions of the ball while moving and standing with the ball. In some embodiments, the apparatus may include a backing plate and a sight shield. The backing plate may have a body surface disposable towards the torso of the user. The sight shield may be coupled to the backing plate, and the sight shield may extend away from the backing plate. When the apparatus is worn by a user, the sight shield may be positioned on or over the torso of the user, and the sight shield may be configured to obscure the area immediately in front of the user.

In further embodiments, the apparatus may comprise a harness configured to attach to the chest or torso a user, and the harness may be used or worn by the user to removably couple the apparatus to the torso of the user.

In even further embodiments, a sight shield may be made from paper, cardboard, plastic, foam or any other disposable or non-disposable material and the sight shield may be temporarily coupled to an article of clothing such as a shirt with removable adhesive.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
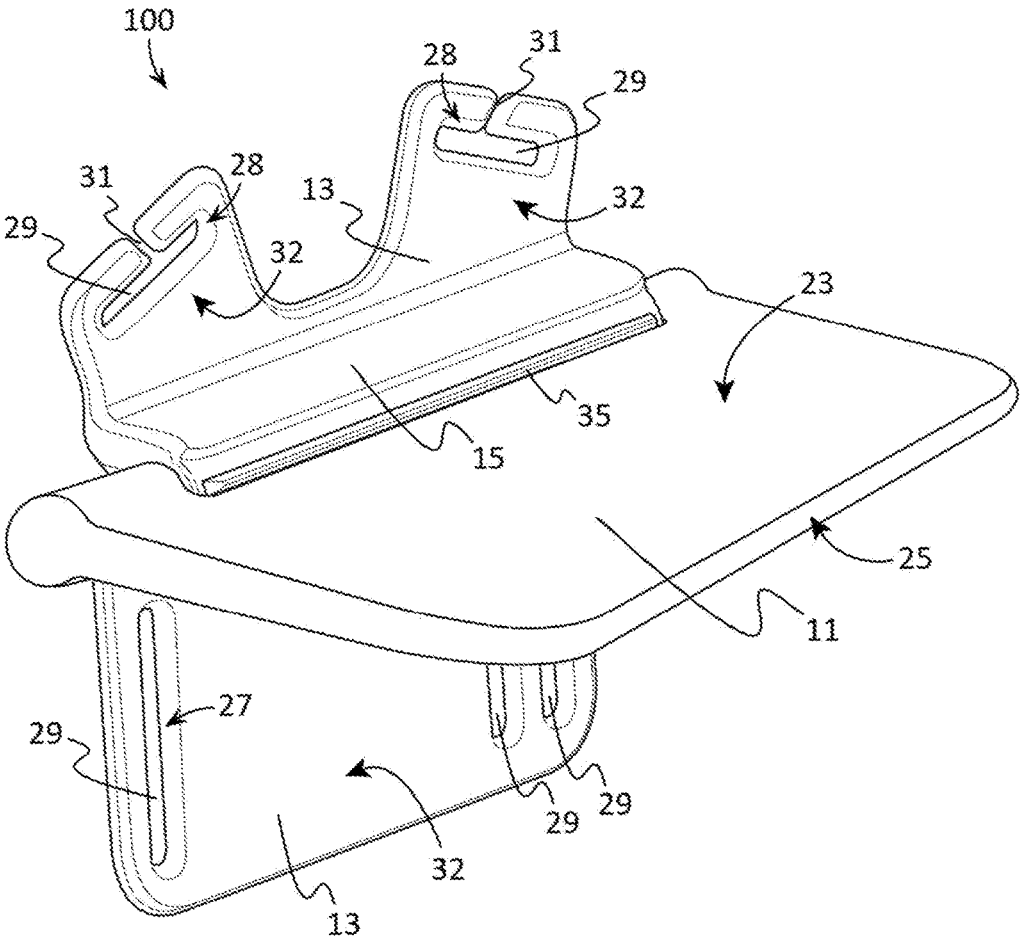
FIG. 1 depicts a front perspective view of an example of a soccer training apparatus according to various embodiments described herein.
Figure 2:
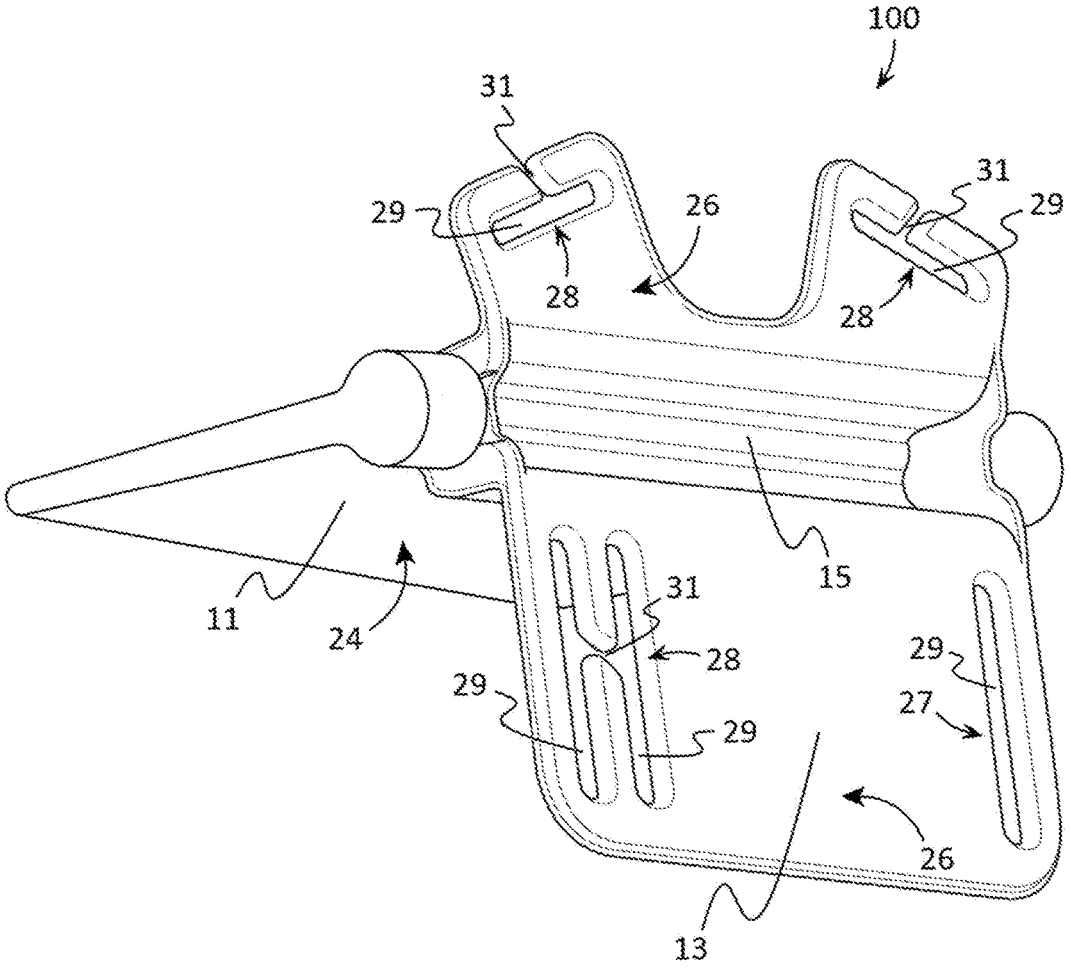
FIG. 2 illustrates a rear perspective view of an example of a soccer training apparatus according to various embodiments described herein.

For purposes of description herein, the terms "upper", "lower", "left", "right", "rear", "front", "side", "vertical", "horizontal", and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

New apparatuses configured to improve athletic performance are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

The present invention will now be described by example and through referencing the appended figures representing preferred and alternative embodiments. FIGS. 1-10 illustrate examples of a soccer training apparatus ("the apparatus") 100 according to various embodiments. In some embodiments, the apparatus 100 may comprise a sight shield 11 which is configured to be positioned on the chest or torso 201 of a user 200. The sight shield 11 may be coupled to a harness 12 which is configured to be temporarily worn by or attached to the user 200. The sight shield 11 may be made from an opaque or translucent material and may be configured to extend generally perpendicularly from the chest of the user 200 a sufficient distance to require the user 200 to lean slightly forward to view the ball 300 when standing or performing ball controlling maneuvers such as shooting, passing, dribbling, and the like. While the soccer training apparatus 100 may be described herein with examples and terms that may describe the sport of soccer, the apparatus 100 may be used in any ball contacting or non-ball contacting sport. By obscuring the area immediately in front of the user 200, the user 200 is required to lean forward to view the area, thereby training the posture of the user in sports activities such as steeple chase, cross country running, cross country skiing, football, rugby, or any other sport where the participant is required to move through an area.

Figure 3:
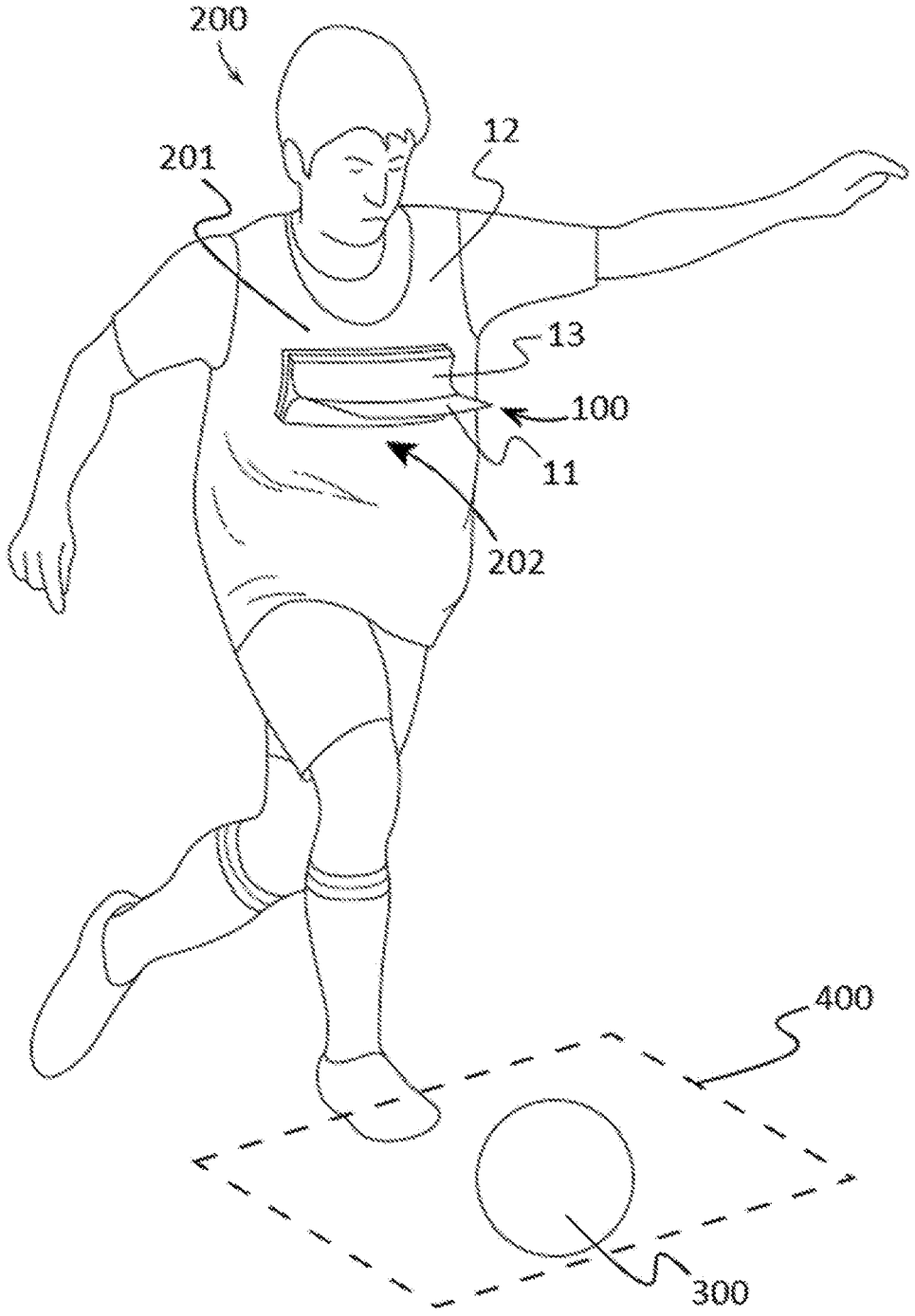
FIG. 3 shows a front perspective view of another example of a soccer training apparatus secured a user according to various embodiments described herein.
Figure 4:
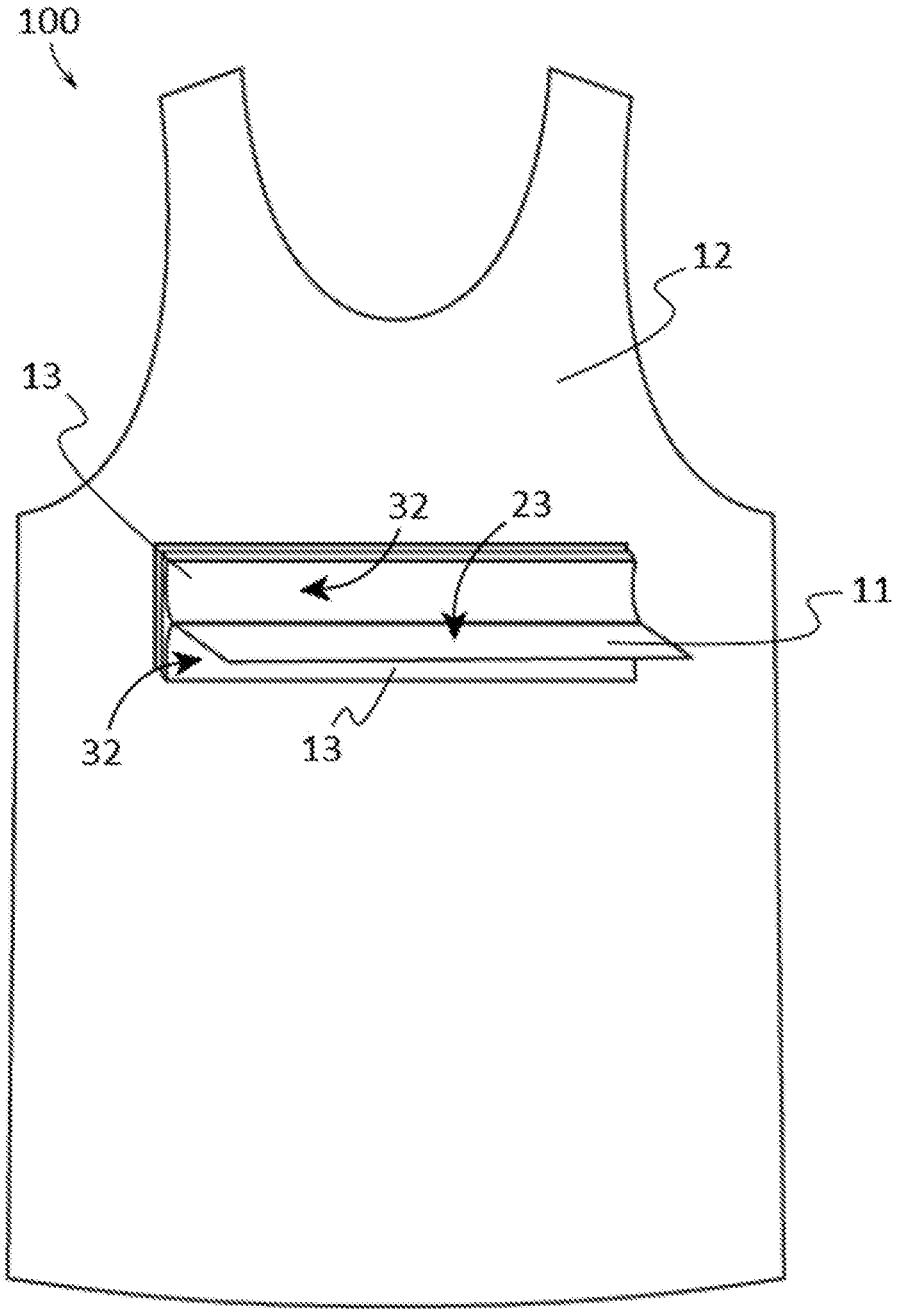
FIG. 4 depicts a front elevation view of another example of a soccer training apparatus according to various embodiments described herein.
Figure 5:
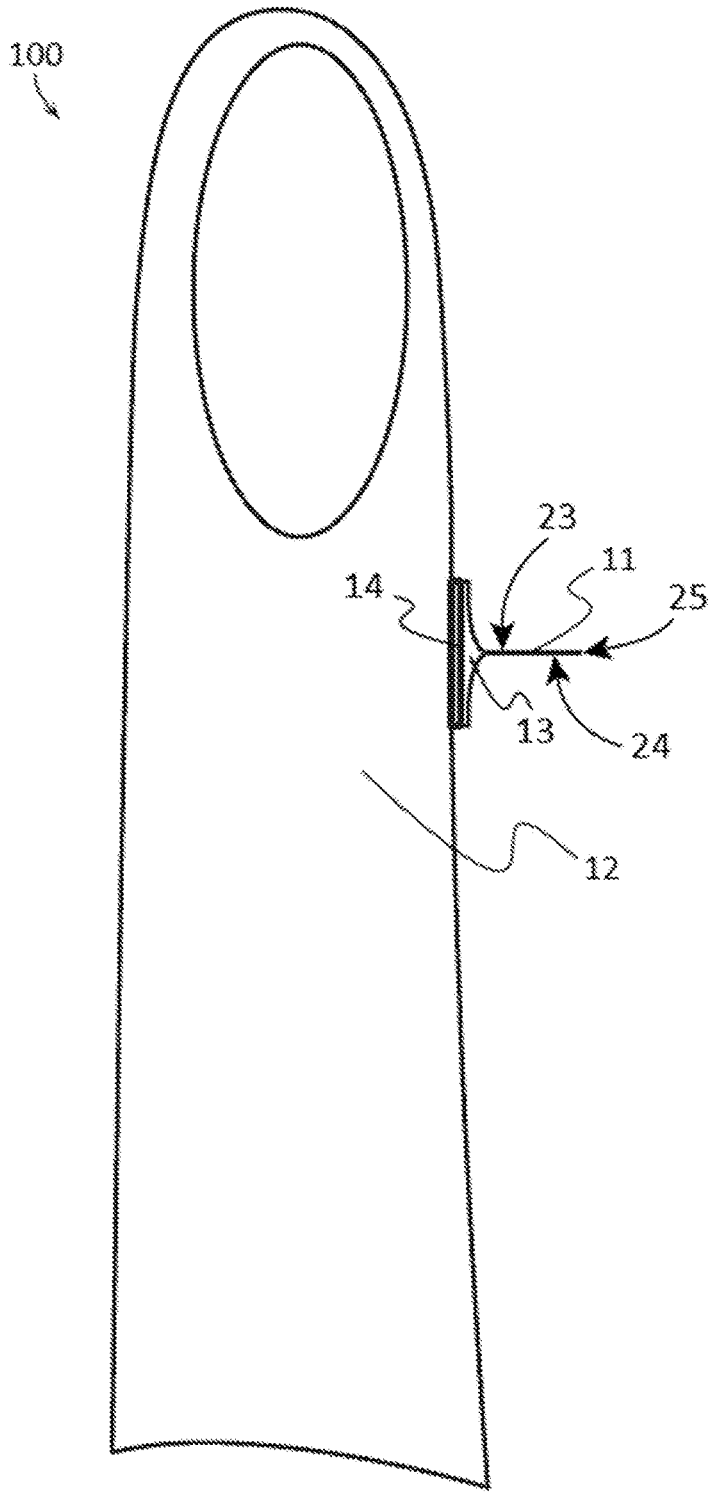
FIG. 5 illustrates a side elevation view of another example of a soccer training apparatus according to various embodiments described herein.
Figure 8:
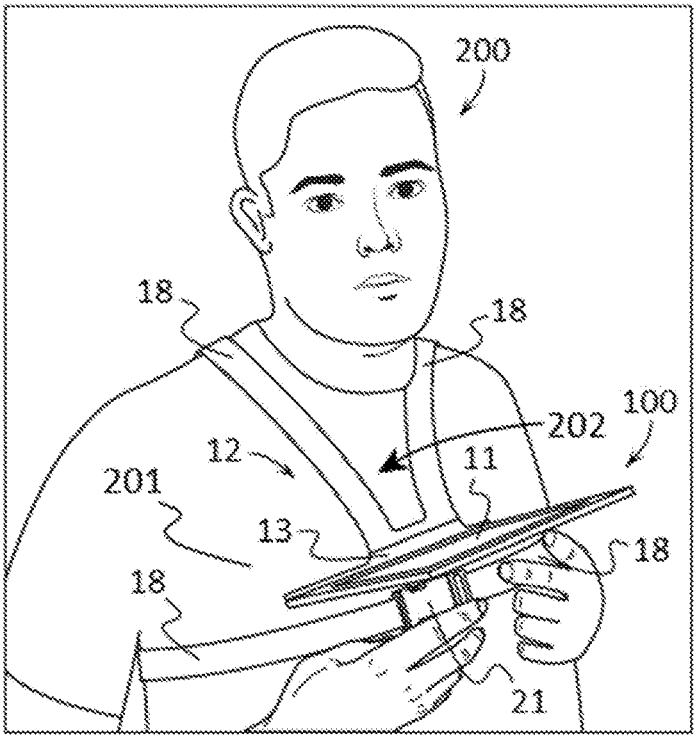
FIG. 8 illustrates a front perspective view of yet another alternative example of a soccer training apparatus secured a user according to various embodiments described herein.

The apparatus 100 may comprise one or more sight shields 11 which may generally extend away from the torso 201 of a user 200 when the apparatus 100 is disposed or worn on the front 202 of the torso 200 of the user 200 as shown in FIGS. 3 and 8. When disposed or worn on the front 202 of the torso 200 of the user 200 the sight shield 11 may block the user's field of view to prevent the user 200 from observing an area immediately or generally in front of the user 200 thereby allowing the apparatus 100 to generate an obscured area 400 (FIG. 3) immediately or generally in front of the user 200. In order to block the user's field of view, the sight shield 11 may be made from or may comprise opaque materials or generally non-transparent materials. In alternative embodiments, order to block the user's field of view, the sight shield 11 may be made from or may comprise translucent materials which may not be opaque or transparent.

In some embodiments, an obscured area 400 may described an area immediately or generally in front of the user 200 which may be centered ventral medial to the user's body and extending away from the feet of the user 200. The size of the obscured area 400 will be dependent on the dimensions of the sight shield 11, the body structure of the user 200, and the distance the sight shield 11 is from the ground when worn by the user 200. Therefore, descriptions of the obscured area 400 are for illustrative purposes only. In some embodiments, the entire ball 200 and/or the entire feet of the user 200 may not be obscured from the view of the user 200 while the user 200 is standing or moving with the ball 300. In further embodiments, the ball 300 and/or one or more of the feet of the user 200 may only be partially obscured while the user 200 is standing or moving with the ball 300 so that the user 200 may be required to lean forward slightly to optionally view more of or the entirety of the ball 300 and/or one or more of the feet of the user 200. In some embodiments, the user 200 may be required to lean forward approximately 1.0 degrees to 40 degrees relative to their typical posture with about 30 degrees being optimal. In still further embodiments, an area immediately in front of a user 200 may be described as the area generally accessible to the user in a walking, running, or jumping stride.

In some embodiments, the apparatus 100 is configured to obscure an area in front of the user 200 while the user 200 is standing or moving with the ball 300 of approximately half of one square foot. In some embodiments, the sight shield or apparatus 100 could be as little as protruding only 2-3 inches from the chest of the user 200 (actual distances may depend on youth & adult sizes). In other embodiments, the apparatus 100 is configured to obscure an area in front of the user 200 while the user 200 is standing or moving with the ball 300 of approximately half of one square foot to approximately two square feet. In other embodiments, the apparatus 100 is configured to obscure an area in front of the user 200 while the user 200 is standing or moving with the ball 300 of approximately 0.5 square feet to approximately four square feet.

A sight shield 11 may be configured in any size and shape. Preferably, a sight shield 11 may be configured with a rectangular prism shape as shown in FIGS. 1-10, 13, and 14. In other embodiments, a sight shield 11 may be configured in a cylindrical shape, a triangular prism shape, or any other shape which may block or prevent a user 200 from observing an area in front of the user 200. A sight shield 11 may comprise an upper surface 23 and an opposing lower surface 24. In some embodiments, and as shown in FIGS. 1-10, 13, and 14, an upper surface 23 and/or a lower surface 24 may comprise a generally planar shape, while in other embodiments, an upper surface 23 and/or a lower surface 24 may comprise a curved shape, angled shape, or any other shape including combinations of shapes. In further embodiments, a sight shield 11 may comprise a distal edge 25 which may form the portion of the sight shield 11 that may extend the furthest from a backing plate 13 preferably joining an upper surface 23 and a lower surface 24 together.

Figure 11:
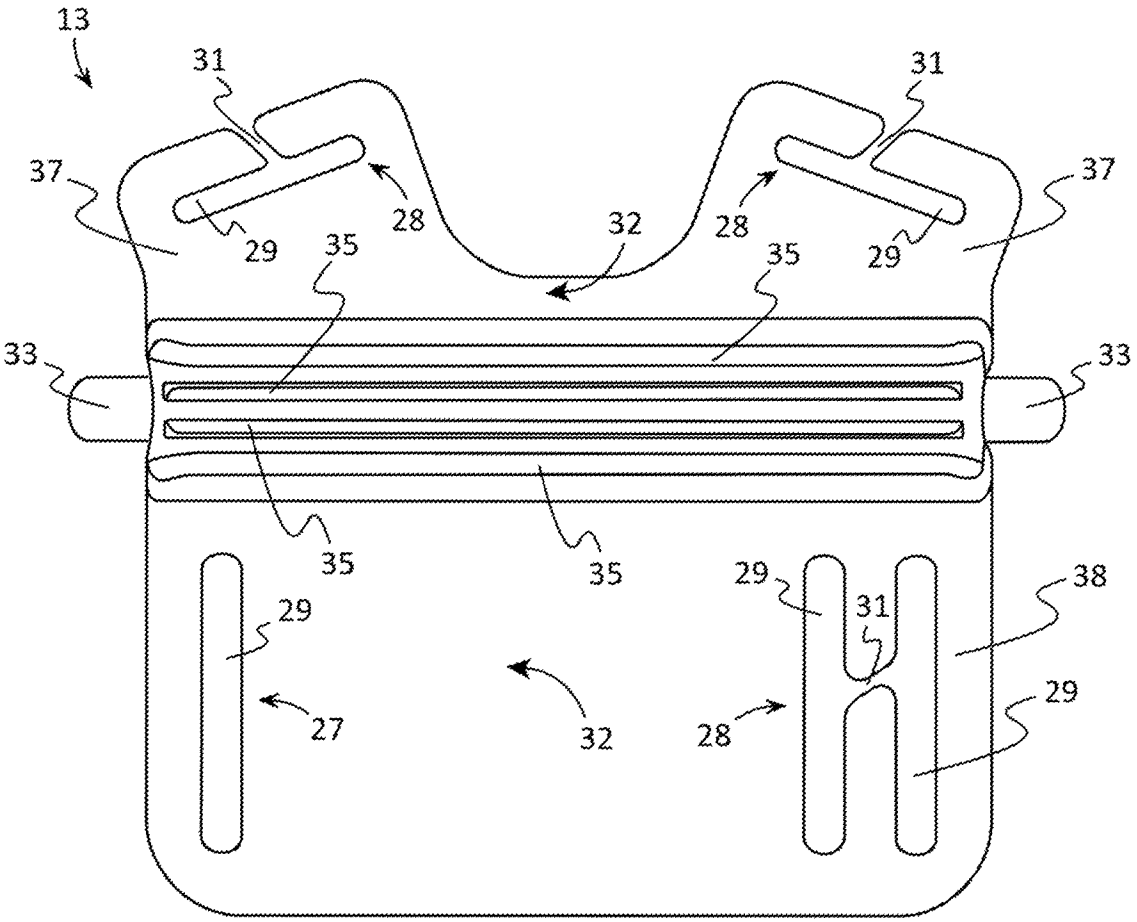
FIG. 11 illustrates a front elevation view of an example of a backing plate according to various embodiments described herein.
Figure 12:
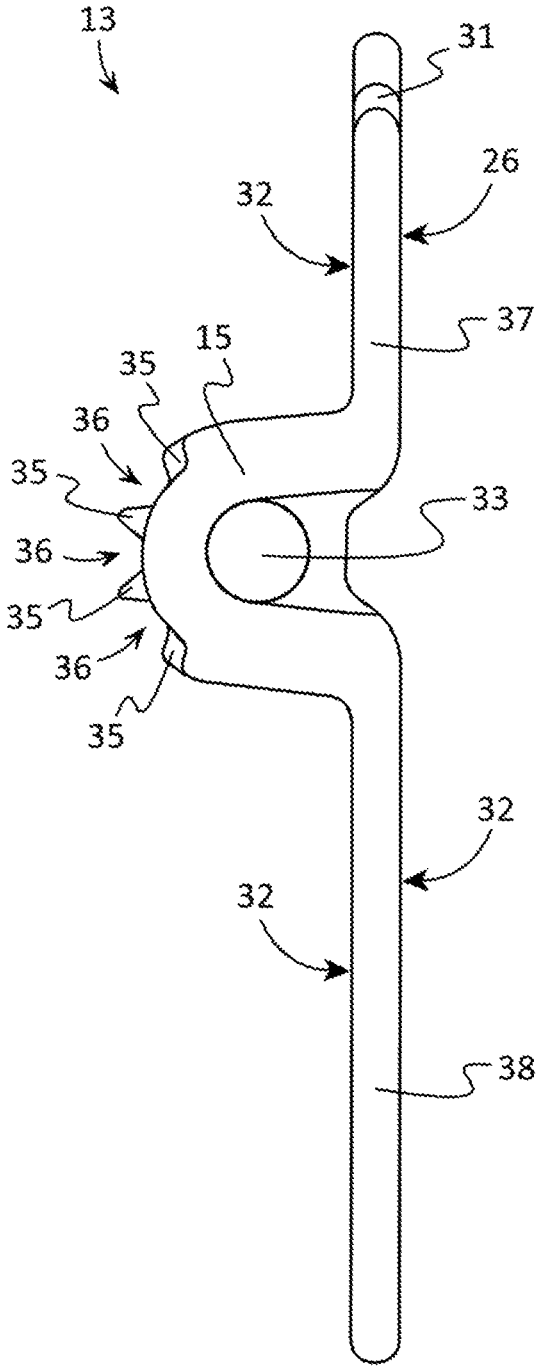
FIG. 12 shows a side elevation view of an example of a backing plate according to various embodiments described herein.
Figure 13:
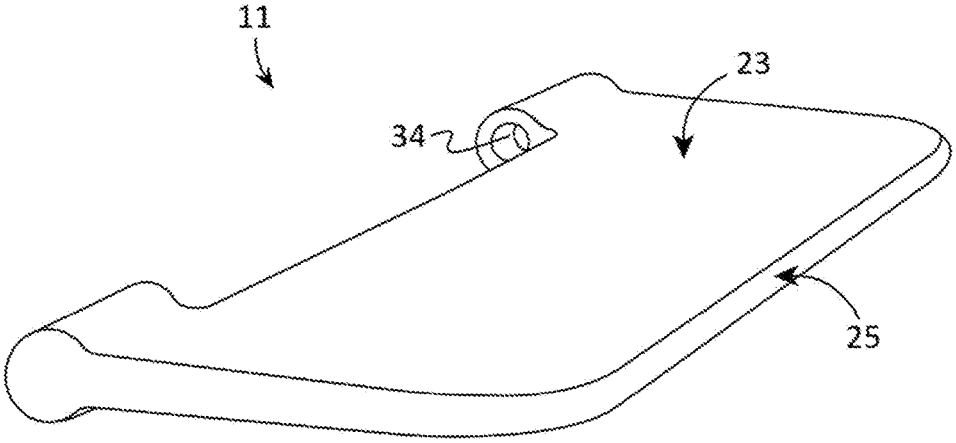
FIG. 13 depicts a top perspective view of a first side of an example of a sight shield according to various embodiments described herein.
Figure 14:
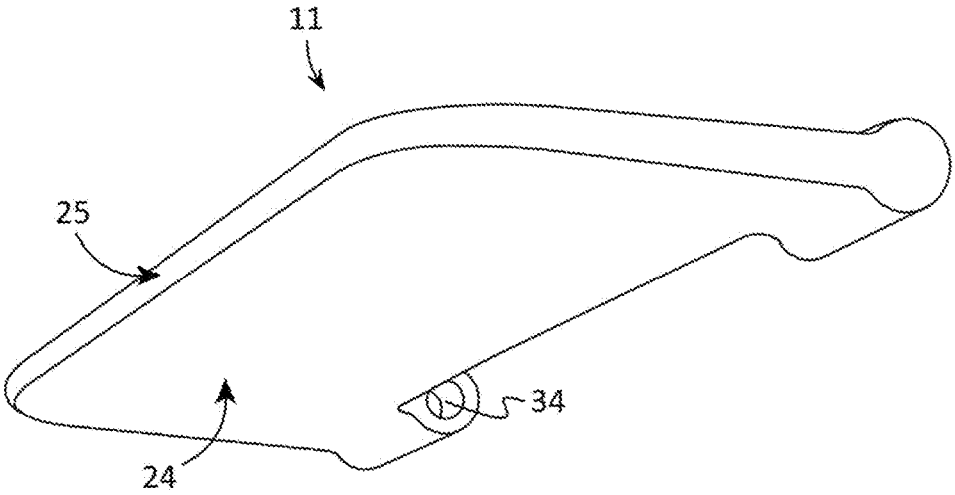
FIG. 14 illustrates a bottom perspective view of a second side of an example of a sight shield according to various embodiments described herein.

In preferred embodiments, the apparatus 100 may comprise one or more backing plates 13 which may be configured to provide structural support to maintain the sight shield 11 on a harness 12 during intense physical activities such as contact sports. A sight shield 11 may be coupled to a backing plate 13, and the backing plate 13 may rest against the front 202 of the torso 201 of the user 200. In some embodiments a sight shield 11 may be movably coupled to a backing plate 13, while in further embodiments a sight shield may be non-movably coupled to a backing plate 13. A backing plate 13 may comprise a body surface 26 which may be disposable towards the torso 201 of the user 202 when the apparatus 100 is worn by the user 200. A backing plate 13 may also comprise a frontal surface 32 which may be disposed on the opposite side of the backing plate 13 relative to the body surface 26. Optionally, a backing plate 13 may comprise one or more upper plate arms 37 which may extend away from one or more optional lower plate arms 38 as shown in FIGS. 11 and 12. A plate arm 37, 38, may comprise a body surface 26 and/or extend the size of a body surface 26 to facilitate the stabilization of the backing plate 13 on and against the torso 201. In some embodiments, one or more harness apertures 27, 28, may be disposed on an upper plate arm 37 or a lower plate arm 38.

Optionally, a body surface 26 may be removably coupled or temporarily coupled to an article of clothing such as a shirt, jersey, or pinnie with removable adhesive or a removable fastener. In preferred embodiments, a body surface 26 and/or a frontal surface 32 may be generally planar in shape. In alternative embodiments, a body surface 26 may be concave curved, convex curved, or configured with any other shape which may allow the body surface 26 to rest comfortably against portions of the torso 201 of a user 200. In further embodiments, a frontal surface 32 may be concave curved, convex curved, or configured with any other shape.

In some embodiments, the sight shield 11 may be configured to be coupled generally perpendicularly to the backing plate 13 allowing the sight shield 11 to extend away from the chest of the user 200 requiring the user 200 to lean forward in order to observe portions of their feet and/or the ball while the user 200 is standing or moving with the ball 300. In preferred embodiments, a sight shield 11 may be coupled generally perpendicularly to the backing plate 13 so that the upper surface 23 and/or lower surface 24 are approximately perpendicular or approximately ninety degrees relative to the frontal surface 32.

In some embodiments, a backing plate 13 may comprise one or more closed harness apertures 27 and/or open harness apertures 28. Preferably, a harness aperture 27, 28, may form an aperture in the backing plate 13 and extending through the backing plate 13 which may receive portions of a harness 12, one or more fasteners, or any other object which may be used to secure the backing plate 13 to a harness 12 or article of clothing 500 such as a shirt, pinnie, or jersey. A closed harness aperture 27 may comprise one hole or opening 29 through which portions of a harness 12, one or more fasteners, or any other object which may be used to secure the backing plate 13 may be received. A closed harness aperture 27 may comprise two or more holes or openings 29 which may be joined together with a harness channel 31. A harness channel 31 may be relatively narrower than an opening 29 and may allow objects such as a length of webbing or strap to be moved between two openings 29 or out of an opening 29.

While in some embodiments the sight shield 11 and the backing plate 13 may each comprise a generally rectangular planar shape, in other embodiments, the sight shield 11 and/or the backing plate 13 may be square shaped, cylinder shaped, cuboid shaped, rectangular prism shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes may be made without departing from the spirit or scope of the invention.

In preferred embodiments, the sight shield 11 and/or backing plate 13 may be made from or comprise resilient materials such as soft plastics, foam plastic, foam rubber, silicone, soft rubber, or any other suitable materials including combinations of substantially rigid materials and flexible materials which may be configured to collapse or resiliently deform upon impact to prevent injury. In alternative embodiments, a sight shield 11 or any other element of an apparatus 100 may be made from paper, cardboard, plastic, foam or other material and the sight shield 11 may be temporarily coupled to an article of clothing 500 (FIG. 6) such as a shirt, jersey, or pinnie with removable adhesive or a removable fastener 14. In further alternative embodiments, a sight shield 11 may be made from paper, cardboard, plastic, foam or other material and the sight shield 11 may be temporarily coupled to a backing plate 13 and/or harness 12 with removable adhesive or a removable fastener 14.

Figure 6:
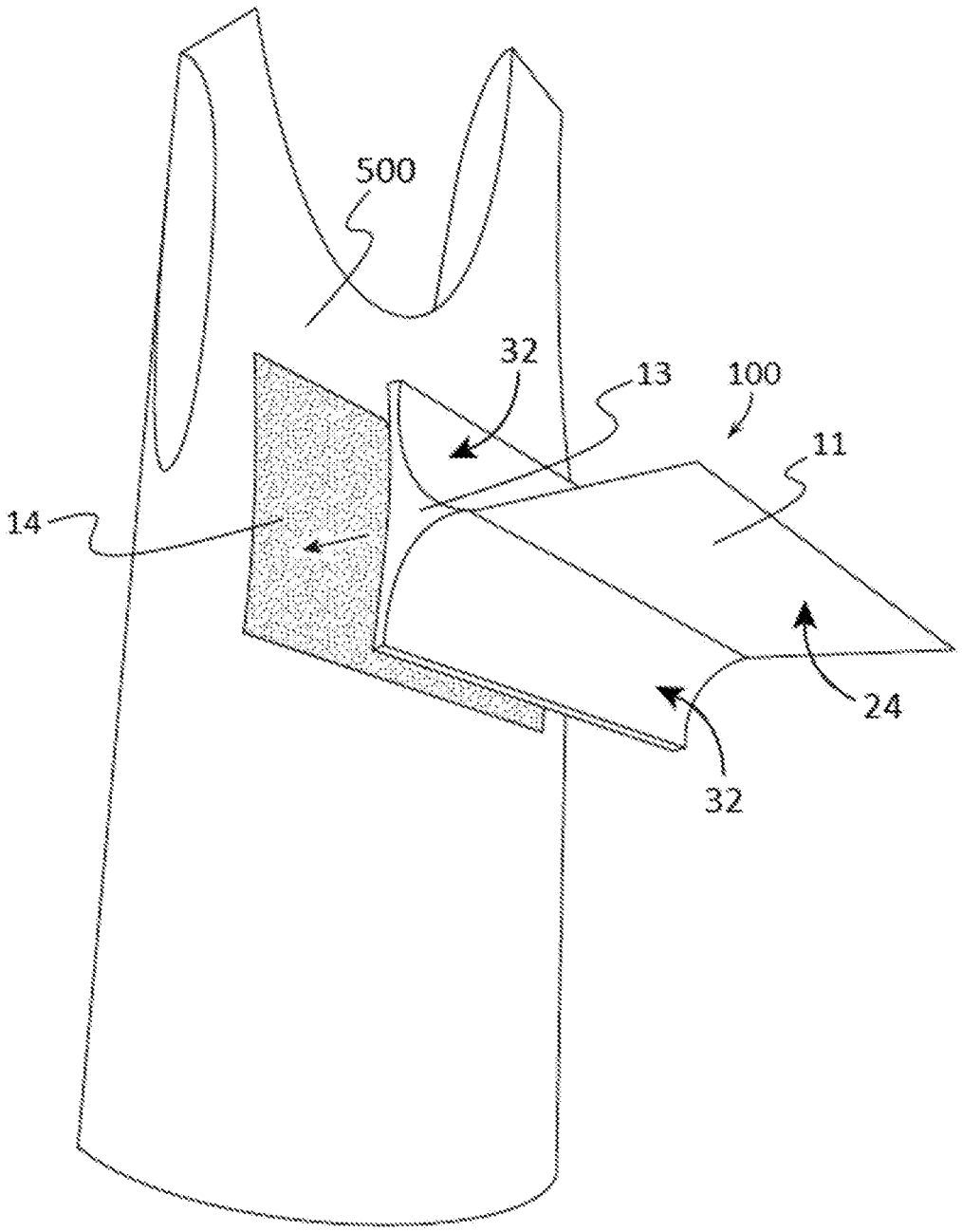
FIG. 6 shows a front perspective view of an alternative example of a sight shield of a soccer training apparatus according to various embodiments described herein.

In some embodiments, a sight shield 11 may be removably coupled to an article of clothing 500, and the sight shield 11 may be temporarily coupled to the article of clothing 500 with removable adhesive or a removable fastener 14 as shown in FIG. 6. In other embodiments, a backing plate 13 may be removably coupled to an article of clothing 500, and the backing plate 13 may be temporarily coupled to the article of clothing 500 with removable adhesive or a removable fastener 14. In still other embodiments, a harness 12 may be removably coupled to an article of clothing 500, and the harness 12 may be temporarily coupled to the article of clothing 500 with removable adhesive or a removable fastener 14.

In some embodiments, the apparatus 100 may comprise a harness 12. The sight shield 11 and/or a backing plate 13 may be coupled to a harness 12 which may be temporarily secured to a user 200 as shown in FIGS. 3 and 8. In some embodiments, the harness 12 may comprise a pinny or pinnie which may be an article of clothing 500 (FIG. 6) and which are also commonly known as bibs or vests, that refer to the colorful practice shirts that players wear when a drill or activity calls for the players to be broken up into teams. In other embodiments, a harness 12 may comprise a shirt, vest, elastic bands, webbing straps, tie-on configurations of fabric, tie-on configurations of other flexible materials, or any other configuration or arrangement of flexible and/or durable materials that may be temporarily secured to or worn by a user 200.

FIG. 6 depicts a perspective view of the front of an alternative example of a soccer training apparatus 100 according to various embodiments described herein. In some embodiments and in the present example, the sight shield 11 may be permanently or temporarily coupled to a backing plate 13, and the backing plate 13 may be removably coupled to a harness 12 with a removable fastener 14. The backing plate 13 and harness 12 may each comprise a removable fastener 14 such as a hook and loop type or Velcro® fastener, although any other type of removable fastener may be used, which may be used to temporarily or removably couple a backing plate 13 and therefore the sight shield 11 to the harness 12. In further embodiments, one or more sight shields 11 may be permanently or temporarily coupled to one or more optional backing plates 13 and one or more backing plates 13 may be temporarily coupled to a harness 12. In other embodiments, the sight shield 11 may be temporarily or permanently coupled to a harness 12. In further embodiments, one or more sight shields 11 may be temporarily or permanently coupled to a harness 12.

Figure 9:
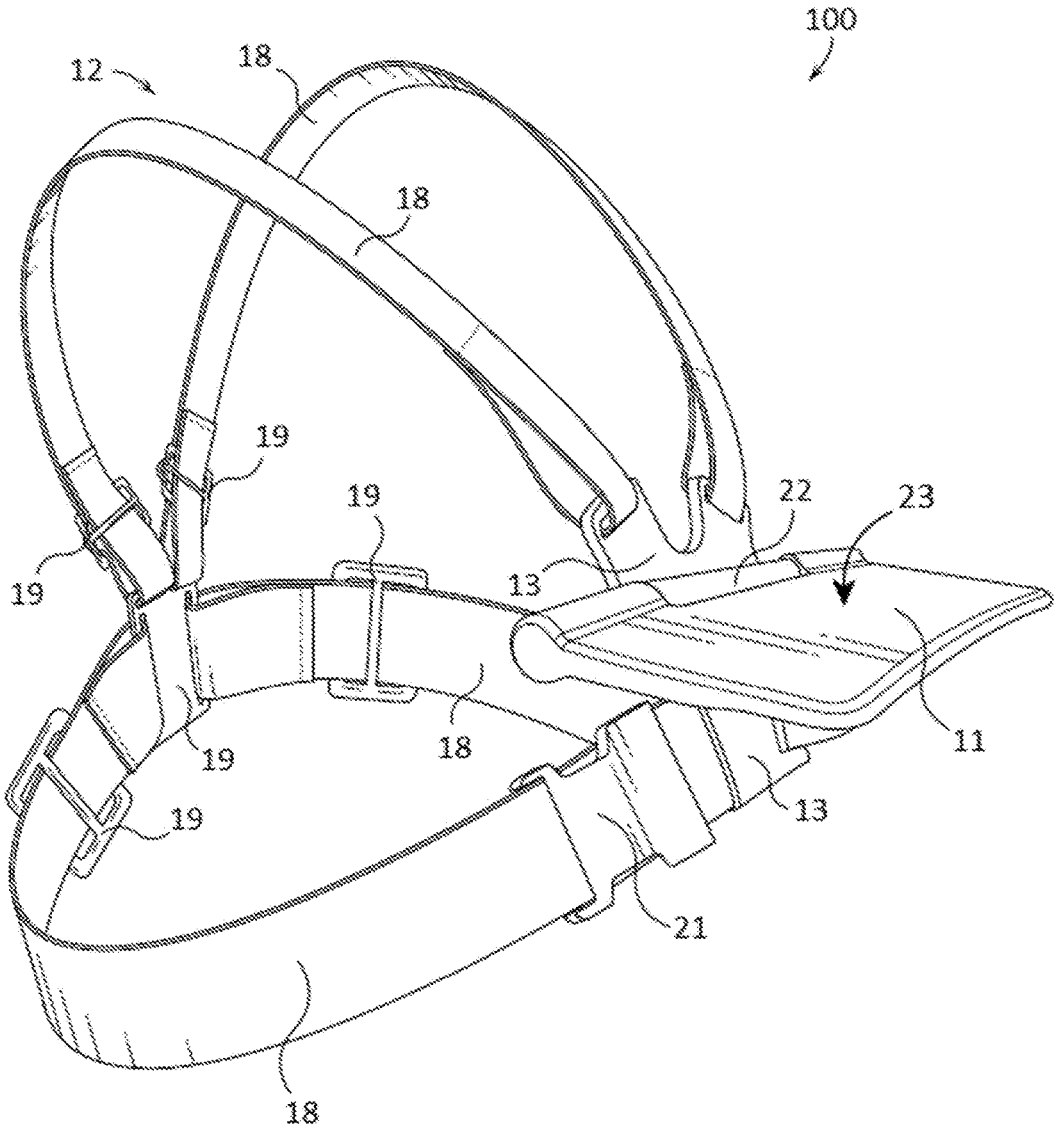
FIG. 9 shows a perspective view of a further example of a soccer training apparatus according to various embodiments described herein.

As shown by FIGS. 8 and 9, in some embodiments, a harness 12 may be formed by one or more straps 18 which may extend around portions of a user 200, such as their torso 201, and used to secure the apparatus 100 to the user 200. Additionally, the apparatus 100 may comprise strap or buckling hardware such as loops 19 (FIGS. 7 and 9) and side release buckles 21 (FIGS. 8 and 9). A harness 12 may be formed from or may comprise a flexible material which may be able to generally conform or wrap around portions of a user's torso 201 when worn by the user 200. A flexible material may comprise synthetic materials and fibers such as nylon webbing, polypropylene webbing, polyester webbing, other types of webbing, neoprene foam rubber, silicone, plastic, rubber, polyester fabrics, rayon fabrics, and natural materials and fibers such as cotton webbing, flax webbing, other fabrics, such as flax, coir, cotton, hemp, jute, leather, linen, ramie, wool, silk or any other type of natural or synthetic fibers or materials including combinations of materials. Buckling hardware may optionally be used to change the size, couple, or uncouple portions of the harness 12 to a user 200 and may include one or more side release buckles, buckles, clasps, slides, loops, reducers, cam buckles, strap adjusters, snap hooks, D rings, tri-loops, footman loops, keepers, cord locks, strap locks, or any other suitable means for adjusting the harness 12.

FIG. 8 shows a perspective view of another alternative example of a soccer training apparatus 100 secured a user 200 according to various embodiments described herein. In this example, the harness 12 comprises one or more straps 18 which may extend around portions of a user 200, such as their chest or torso 201, to secure the apparatus 100 during sports activities such as soccer. In some embodiments, the backing plate 13 may coupled to one or more straps 18 forming a harness 12 which may be secured to the chest of a user 200 with one or more side release buckles 21. In further embodiments, the backing plate 13 may be removably coupled to a harness 12. In still further embodiments, the sight shield 11 may be coupled to the backing plate 13 with removable fasteners 14 thereby removably coupling the sight shield 11 to the harness 12. In still further embodiments, a shield extension 15 (FIGS. 7 and 12) may be coupled to the backing plate 13 with removable fasteners 14 and the sight shield 11 may be coupled, and preferably movably coupled, to the shield extension 15, thereby removably and movably coupling the sight shield 11 to the harness 12. In still further embodiments, a hinged coupling 22 may pivotally couple a sight shield 11 to a shield extension 15.

Figure 7:
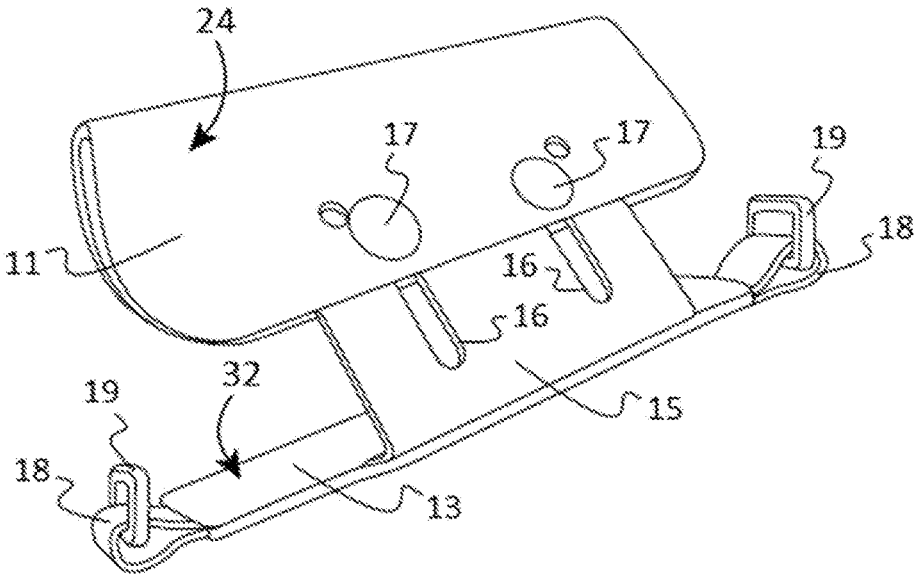
FIG. 7 depicts a front perspective view of another alternative example of a soccer training apparatus according to various embodiments described herein.

Referring to FIG. 7, in some embodiments the sight shield 11 may be configured to be movable relative to a backing plate 13 by being slidably coupled to the backing plate 13. The apparatus 100 may comprise a shield extension 15 which may be coupled to the backing plate 13 and which may extend away from a frontal surface 32 of the backing plate 13. Optionally, the shield extension 15 may be pivotally coupled to the backing plate 13 allowing the shield extension 15 to be angled in various positions toward the head of the user 200 and/or angled in various positions towards the feet of the user 200 to obscure different area sizes and to accommodate anatomical differences between users of different sex, body type, and body size. The sight shield 11 may be movably or slidably coupled to the shield extension 15 allowing all or portions of the sight shield 11 to be moved closer or further from the backing plate 13. In some embodiments, portions of the shield extension 15 may be received within the sight shield 11 allowing the shield extension 15 to be retracted into or extended from the sight shield 11 although any other suitable movable coupling method may be used.

When the apparatus 100 is worn by a user 200 and the sight shield 11 is extended out fully or partially away from the harness 12 worn on the chest of a user 200, the sight shield 11 may fully obscure the user's 200 ability to view the ball 300 when the ball 300 is in the area in front of the user 200. By fully obscuring the user's 200 ability to view the ball 300 when the ball 300 is in the area in front of the user 200, the apparatus 100 may function to train cognitive skills to the user 200. Cognitive skills training may force the user 200 to rely on memory and cognitive ability to manipulate the ball 300 instead of relying on visually locating the ball 300. The sight shield 11 of the apparatus 100 when extended fully or partially to the extent that it obscures completely or partially the view of the ball 300 even with a user's 200 corrected posture works to develop cognitive abilities or game intelligence. This also allows the user 200 to challenge their brain and force cognitive development to take place, ultimately, increasing mental capacity.

In some embodiments, a sight shield 11 may comprise one or more shield fasteners 17 and a shield extension 15 may comprise one or more shield channels 16 which may receive a shield fastener 17. A shield fastener 17 may comprise any type of fastener, such as a threaded fastener, a magnetic fastener, a push-to-lock fastener, or nay other type of fastener which may be suitable for coupling a sight shield 11 to a shield extension 15. For example, a shield fastener 17 may comprise a threaded hand tighten-able fastener which when tightened may fix the position of the sight shield 11 on the shield extension 15. When the shield fastener 17 is un-tightened or loosed, the sight shield 11 may be moved into closer or further positions from the backing plate 13. In other embodiments, any other method of movably coupling a sight shield 11 to a backing plate 13 may be used. In further embodiments, a sight shield 11 may be movably coupled to a backing plate 13 and/or harness 12 to allow the sight shield 11 to be movable between 0.5 inches and ten inches from the backing plate 13 and/or harness 12. For example, a youth sized apparatus 100 may comprise a sight shield 11 which may be movable between 0.5 inches and four inches from the backing plate 13 and/or harness 12, while an adult sized apparatus 100 may be movable between two inches and ten inches from the backing plate 13 and/or harness 12.

In some embodiments, a sight shield 11 may be pivotally coupled to a backing plate 13 and/or to another element of the apparatus 100 with a hinged coupling 22. A hinged coupling 22 may be configured to allow the sight shield 11 to be angled in various positions toward the head of the user 200 and/or angled in various positions towards the feet of the user 200 to obscure different area sizes and to accommodate anatomical differences between users of different sex, body type, and body size. In this regard, the shield 11 may be configured for disturbing the total vision of the ball 300 to increase tactile feel and developing the mind's eye in working on decreasing the need to look at ball 300.

Figure 10:
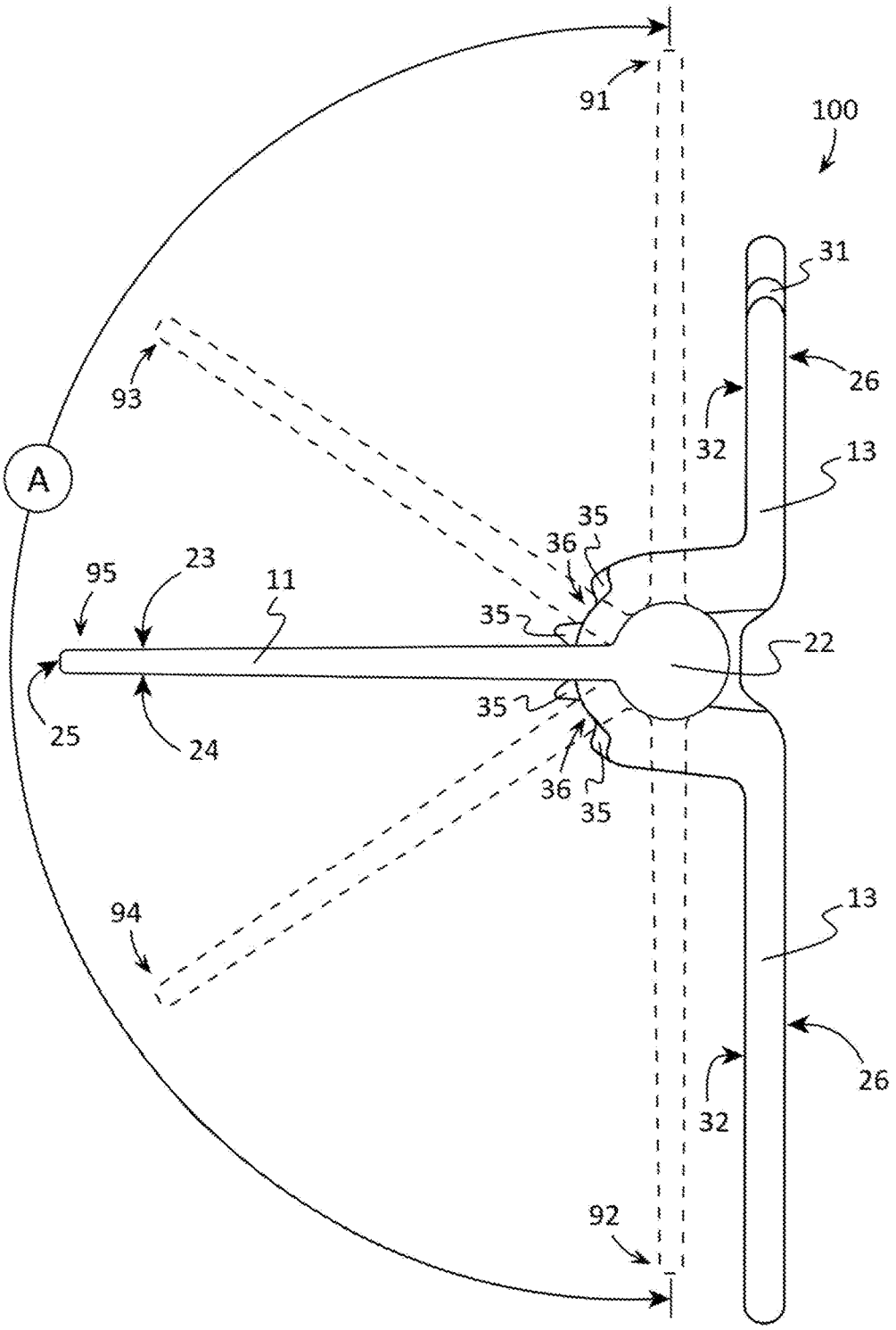
FIG. 10 depicts a side elevation of still another example of a soccer training apparatus according to various embodiments described herein.

As perhaps best shown in FIG. 10, in some embodiments a hinged coupling 22 may be configured to allow the sight shield 11 to be pivoted towards and away from portions of the backing plate 13, and therefore from portions of the body of a user 200, so that varying amounts of the vision of the user 200 may be obstructed by the sight shield 11 to form an obscured area 400 of varying sizes as shown by Angle A. In further embodiments, some embodiments a hinged coupling 22 may be configured to allow the sight shield 11 to be pivoted towards a portion of the body of a user 200 so that the vision of the user 200 may not be obstructed by the sight shield 11. For example, a hinged coupling 22 may allow the sight shield 11 to be folded proximate to the torso 201 of the user 200 when the user is taking a break or performing some other activity without requiring the apparatus 100 or elements of the apparatus 100 to be removed from the user 200.

In some embodiments and as shown in FIGS. 11-14, elements of a hinged coupling 22 may be disposed on both the sight shield 11 and on the backing plate 13. For example, a backing plate 13 may comprise one or more hinge pins 33 and a sight shield 11 may comprise one or more hinge receptors 34. Each hinge pin 33 may be received in a hinge receptor 34, and the hinge receptors 34 may pivot around the hinge pins 33 so that the hinge pins 33 may provide an axis of rotation described by Angle A. In alternative embodiments, a sight shield 11 may comprise one or more hinge pins 33 and a backing plate 13 may comprise one or more hinge receptors 34.

In preferred embodiments, a sight shield 11 may be pivotally coupled to the backing plate 13 and movable between a first position 91 and a second position 92 and optionally to one or more positions between such as a third position 93 and a fourth position 94. Preferably, a sight shield 11 may be movable into and out of a fifth position 95 in which the sight shield 11 may be generally perpendicular to the backing plate 13. In further embodiments, the distal edge 25 of a sight shield 11 may be movable between a first position 91 and a second position 92 as shown by Angle A. In further embodiments, an upper surface 23 and/or a lower surface 24 may be pivoted towards and away from a frontal surface 32 between a first position 91 and a second position 92 also shown by Angle A. In preferred embodiments, Angle A may be approximately 180 degrees. In further embodiments, Angle A may be between 45 and 135 degrees.

In some embodiments, a backing plate 13 may comprise one or more ribs 35 which may extend away from the frontal surface 32 of the backing plate 13 and which may be optionally disposed on a shield extension 15. A rib 35 may comprise a protrusion against which portions of the sight shield 11 may be supported to maintain the sight shield in a desired position 91, 92, 93, 94, 95. Preferably, the ribs 35 may comprise generally elongated protrusions, and a rib channel 36 may be formed between two adjacent ribs 35. The rib channels 36 may be shaped to receive portions of the sight shield 11 to maintain the sight shield 11 in a desired position 91, 92, 93, 94, 95, and the ribs 35 and/or sight shield 11 may be comprise a resilient material which enables the sight shield 11 to be flexed into different rib channels 36. Additionally, the sight shield 11 and/or backing plate 13 may be flexed to enable the hinge pins 33 and hinge receptors 34 to be coupled and un-coupled so as to allow the sight shield 11 to be removably coupled to the backing plate 13.

In other embodiments, the sight shield 11 may be pivotally coupled to the backing plate 13 with one or more hinged couplings 22 which may include a butt hinge, butterfly hinge, flush hinge, barrel hinge, concealed hinge, continuous hinge, T-hinge, strap hinge, double-acting hinge, Soss hinge, a flexible material hinge, or any other type or style of hinge or pivotal joining method. In further embodiments, a hinged coupling 22 may comprise any type of hinge known in the art, including so-called "living" hinges, which typically comprise a linear, relatively flexible area between two relatively more rigid components, such as a line of thin plastic between thicker plastic portions, as is well known in the art that allows portions of a sight shield 11 and backing plate 13 to be pivoted away from each other.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

While some materials have been provided, in other embodiments, the elements that comprise the apparatus 100 such as a sight shield 11, an optional harness 12, an optional backing plate 13, optional shield extension 15, and/or any other element discussed herein may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the apparatus 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the apparatus 100 may be coupled by being one of connected to and integrally formed with another element of the apparatus 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A soccer training apparatus configured to be disposed on the front of a user's chest and above a user's hips, the apparatus comprising:

a backing plate, the backing plate having a body surface disposable towards the user's chest and above the user's hips, a frontal surface opposite to the body surface, a first side positioned between the body surface and the frontal surface and a second side positioned opposite to the first side between the body surface and the front surface, the backing plate further comprising a first hinge pin positioned on the first side and extending outwardly from the first side and a second hinge pin positioned on the second side and extending outwardly from the second side;

a sight shield coupled to the backing plate, the sight shield extending perpendicularly away from the backing plate and in an orientation parallel to the user's hips to block downward line of sight and the sight shield further comprising a first hinge receptor and a second hinge receptor spaced apart from the first hinge receptor, the first hinge receptor configured with a first opening to receive the first hinge pin of the backing plate and the second hinge receptor configured with a second opening to receive the second hinge pin of the backing plate;

a first harness aperture located on the backing plate at a position above the sight shield;

a second harness aperture located on the backing plate at a position below the sight shield;

a harness, wherein the backing plate is coupled to the harness, and wherein the harness is configured to be worn on the chest of the user;

a plurality of ribs extending away from the backing plate, wherein a rib channel is formed between two adjacent ribs of the plurality of ribs; and wherein sight shield is coupled to the backing plate and between two adjacent ribs.

2. The apparatus of claim 1, wherein the sight shield comprises a distal edge, and wherein the distal edge is vertically movable between a first position and a second position.

3. The apparatus of claim 1, wherein the sight shield is pivotally coupled to the backing plate.

4. The apparatus of claim 1, wherein the harness comprises a flexible material.

5. The apparatus of claim 1, wherein the backing plate is removably coupled to the harness.

6. The apparatus of claim 1, wherein a first harness is secured to the backing plate through the first harness aperture and a second harness is secured to the backing plate through the second harness aperture.

7. The apparatus of claim 1, wherein the body surface is generally planar.

8. The apparatus of claim 1, wherein sight shield is coupled generally perpendicular to the backing plate and temporarily and rigidly fixed to the backing plate to resist accidental movement of the sight shield relative to the backing plate when in use.

9. The apparatus of claim 1, wherein sight shield is removably coupled to the backing plate.

* * * * *